US008186548B2

(12) United States Patent
Levine et al.

(10) Patent No.: US 8,186,548 B2
(45) Date of Patent: May 29, 2012

(54) SHOE-COVER DISPENSER

(76) Inventors: Stephen Levine, Far Hills, NJ (US); Chris Sidebotham, Mendham, NJ (US)

( * ) Notice: Subject to any disclaimer, the term of this patent is extended or adjusted under 35 U.S.C. 154(b) by 0 days.

(21) Appl. No.: 12/823,048

(22) Filed: Jun. 24, 2010

(65) Prior Publication Data

US 2010/0257749 A1 Oct. 14, 2010

Related U.S. Application Data

(63) Continuation of application No. 11/541,121, filed on Sep. 29, 2006, now Pat. No. 7,757,910.

(60) Provisional application No. 60/818,057, filed on Jun. 30, 2006.

(51) Int. Cl.
*A47G 25/80* (2006.01)

(52) U.S. Cl. ..... 223/113; 221/11; 12/1 R

(58) Field of Classification Search ..... 223/113, 223/111, 118; 221/11; 12/1 R
See application file for complete search history.

(56) References Cited

U.S. PATENT DOCUMENTS

| | | | | |
|---|---|---|---|---|
| 3,689,735 | A | 9/1972 | McLeod et al. | |
| 3,775,793 | A | 12/1973 | Casavant et al. | |
| 6,543,075 | B2 | 4/2003 | Gultekin et al. | |
| 7,448,521 | B2 | 11/2008 | Hu | |
| 7,757,910 | B2 * | 7/2010 | Levine et al. | 223/113 |
| 2002/0020031 | A1 | 2/2002 | Gultekin et al. | |
| 2004/0244337 | A1 | 12/2004 | Asici et al. | |
| 2008/0237277 | A1 | 10/2008 | Xu | |
| 2010/0257749 | A1 * | 10/2010 | Levine et al. | 221/1 |
| 2010/0288800 | A1 * | 11/2010 | Xu | 223/113 |

FOREIGN PATENT DOCUMENTS

| | | | |
|---|---|---|---|
| CN | 1248415 | Y | 3/2000 |
| CN | 1288704 | | 3/2001 |
| CN | 1341393 | | 3/2002 |
| CN | 1442105 | | 9/2003 |
| CN | 1449705 | | 10/2003 |
| CN | 1457735 | | 11/2003 |
| CN | 1481749 | | 3/2004 |
| CN | 2608424 | Y | 3/2004 |
| CN | 2610696 | Y | 4/2004 |
| CN | 2610800 | Y | 4/2004 |
| CN | 2610801 | Y | 4/2004 |
| CN | 2610802 | Y | 4/2004 |
| CN | 2616088 | Y | 5/2004 |
| CN | 2618520 | Y | 6/2004 |
| CN | 2619502 | Y | 6/2004 |
| CN | 2626864 | Y | 7/2004 |
| CN | 2633135 | Y | 8/2004 |

(Continued)

*Primary Examiner* — Ted Kavanaugh
(74) *Attorney, Agent, or Firm* — Klarquist Sparkman, LLP

(57) ABSTRACT

A shoe-cover dispenser is described, including, for example, features that facilitate the simultaneous loading of multiple shoe covers and/or features that prevent incomplete release of shoe covers. The shoe-cover dispenser can include a shell and a removable shoe-cover cartridge sized to fit within the shell. The removable shoe-cover cartridge can be configured to releasably hold a plurality of shoe covers, such as by releasably holding three or more clips attached to an elastic element of each shoe cover. These clips can be preloaded into the removable shoe-cover cartridge prior to delivery to an end-user. Release of a shoe cover can be initiated by downward movement of a foot pad. To prevent tilting of the foot pad, the shell can include a guide plate substantially abutting a substantially vertical side of the foot pad and/or an alignment rod positioned within a substantially vertical hole in the foot pad.

10 Claims, 10 Drawing Sheets

FOREIGN PATENT DOCUMENTS

| | | | |
|---|---|---|---|
| CN | 2633136 | Y | 8/2004 |
| CN | 2634973 | Y | 8/2004 |
| CN | 2634974 | Y | 8/2004 |
| CN | 2638593 | Y | 9/2004 |
| CN | 2652274 | Y | 11/2004 |
| CN | 2657524 | Y | 11/2004 |
| CN | 2666303 | Y | 12/2004 |
| CN | 2666819 | Y | 12/2004 |
| CN | 2680149 | Y | 2/2005 |
| CN | 2680150 | Y | 2/2005 |
| CN | 1593300 | | 3/2005 |
| CN | 2684690 | Y | 3/2005 |
| CN | 2689846 | Y | 4/2005 |
| CN | 2691414 | Y | 4/2005 |
| CN | 2691415 | Y | 4/2005 |
| CN | 1620966 | | 6/2005 |
| CN | 2719154 | Y | 8/2005 |
| CN | 2724558 | Y | 9/2005 |
| CN | 2724559 | Y | 9/2005 |
| CN | 2730257 | Y | 10/2005 |
| CN | 2734067 | Y | 10/2005 |
| GB | 2420960 | | 6/2006 |
| JP | 9117301 | | 5/1997 |
| JP | 2006094990 | | 4/2006 |
| WO | WO 02/003823 | | 7/2001 |
| WO | WO 03/032786 | | 10/2001 |
| WO | WO 2005/089581 | | 3/2005 |

* cited by examiner

SHOE-COVER DISPENSER

CROSS REFERENCE TO RELATED APPLICATION

This is a continuation of U.S. application Ser. No. 11/541,121, filed Sep. 29, 2006, now U.S. Pat. No. 7,757,910 which claims the benefit of the earlier filing date of prior U.S. Provisional Application No. 60/818,057, filed Jun. 30, 2006, both of which are incorporated herein by reference in their entireties.

FIELD

This disclosure relates generally to, inter alia, shoe-cover dispensers, such as shoe-cover dispensers that automatically apply a single shoe cover when a user places their shoe in the dispenser.

BACKGROUND

In many environments, such as hospitals, laboratories, clean rooms, crime scenes, computer rooms and homes, it is useful to minimize or eliminate contaminants introduced on the soles of the shoes of people entering the environments. To address this need, it is known to place a cover over each shoe before entering these environments, thereby minimizing the transfer of contaminants. Sterile environments, including hospitals and clean rooms, often require the use of shoe covers as standard operating procedure to maintain the requisite level of cleanliness. There are numerous non-sterile environments that also would benefit from the use of shoe covers, including homes, museums, and beauty salons. High-volume use of shoe covers in these non-sterile environments, however, has been hampered by lack of convenience. The time necessary to hand-place a cover on each shoe has been an obstacle to widespread use of shoe covers, despite their clear benefits.

SUMMARY

Described herein are, inter alia, embodiments of a shoe-cover dispenser. These embodiments can include, for example, features that facilitate the simultaneous loading of multiple shoe covers. Some embodiments include a shell defining a cartridge-receiving opening and a removable shoe-cover cartridge sized to fit within the cartridge-receiving opening. The removable shoe-cover cartridge can be configured to releasably hold a plurality of shoe covers stacked in a shoe-receiving opening, such as by releasably holding three or more clips attached to an elastic element of each shoe cover. For example, the removable shoe-cover cartridge can be configured to releasably hold four clips, each clip being positioned at one respective corner of the shoe-cover cartridge and oriented in substantial alignment with a clip positioned at a diagonally opposite corner of the shoe-cover cartridge. In some embodiments, the removable shoe-cover cartridge is preloaded with a plurality of shoe covers.

Shoe covers can be released one at a time in response to pressure from a user's shoe on a foot pad. The foot pad can be connected to the shell and project into the cartridge-receiving opening such that it is vertically-movable while the shoe-cover cartridge is positioned within the shell. In these embodiments, the shoe-receiving opening can be positioned above the foot pad. Thus, downward force from a shoe in the shoe-receiving opening can be transferred to the foot pad through a plurality of shoe covers in the removable shoe-cover cartridge.

In some embodiments, each connection point between the removable shoe-cover cartridge and the shoe covers includes a vertically actuated trigger. The shell can include a pivoting member connected to the foot pad such that downward motion of the foot pad causes a portion of the pivoting member to move into vertical alignment with the trigger, and upward motion of the foot pad causes the portion of the pivoting member to move out of vertical alignment with the trigger. This prevents the pivoting member from interfering with the trigger when the removable shoe-cover cartridge is moved into or out of the shell.

In some embodiments, the removable shoe-cover cartridge includes four vertical cartridge walls and four vertical columns positioned at the intersections between the vertical cartridge walls, with each vertical column including a vertically actuated trigger. Similarly, the shell can include four vertical shell walls and four vertical channels positioned at the intersections between the vertical shell walls. The vertical cartridge can be configured to fit within the shell such that the average clearance between the vertical cartridge walls and the vertical shell walls is greater than the average clearance between the vertical columns and the vertical channels.

Embodiments having a foot pad can include features for preventing tilting of the foot pad and possible incomplete release of a shoe cover. For example, the shell can include at least one guide plate substantially abutting at least one substantially vertical side of the foot pad. In some embodiments, the foot pad has three or more substantially vertical sides substantially abutted by one or more guide plates. Alternatively, or in addition, the shell can include at least one alignment rod positioned within a substantially vertical hole in the foot pad. A top surface of the alignment rod can be recessed relative to a top surface of the foot pad when the foot pad is in an upright position and then become less recessed relative to the top surface of the foot pad as the foot pad is pressed downward.

Also described herein are embodiments of a shoe-cover assembly for use with a shoe-cover dispenser. Some embodiments include a plurality of shoe covers each including an elastic member and three or more clip-holding columns each containing a stack of clips. The elastic member of each of the plurality of shoe covers can be connected to three or more clips and each of the three or more clips can be positioned within a separate clip-holding column. Each clip-holding column can include a clip-releasing trigger. The shoe-cover assembly can be configured to fit within a shell including an actuator corresponding to each of the triggers. For example, the actuators can be configured to apply pressure to the triggers in response to downward movement of a foot pad in the shell. Embodiments of the disclosed shoe-cover assembly also can include a frame (e.g., an expandable frame) holding the clip-holding columns apart such that the elastic members are stretched beyond their relaxed dimensions.

Embodiments of a method for dispensing shoe covers also are disclosed. These embodiments can include loading a shoe-cover cartridge into a shell and pressing a shoe downward through a shoe-receiving opening in the shoe-cover cartridge and against a foot pad in the shell. This action can cause a single shoe cover to be released around the shoe. After the shoe cover has been dispensed, the shoe can be removed from the shoe-receiving opening in the shoe-cover cartridge.

DETAILED DESCRIPTION

Described herein are embodiments of a shoe-cover dispenser, embodiments of components of the disclosed shoe-cover dispenser, embodiments of a method for making the shoe-cover dispenser, and embodiments of a method for dispensing shoe covers. Throughout this disclosure, the singular terms "a," "an," and "the" include plural referents unless the context clearly indicates otherwise. Similarly, the word "or" is intended to include "and" unless the context clearly indicates otherwise. The word "shoe" is intended to refer to both shod feet (i.e., feet covered with any type of covering including, but not limited to, shoes, socks and stockings) and unshod feet. Similarly, the phrase "shoe cover" is intended to refer to covers for attachment to either shod or unshod feet. Directional terms, such as "upper," "lower," "front," "back," "vertical," and "horizontal," are used herein to express and clarify the relationship between various elements. It should be understood that such terms do not denote absolute orientation (e.g., a "vertical" component can become horizontal by rotating the device).

FIGS. 1-10 show one embodiment of the disclosed shoe-cover dispenser. The illustrated shoe-cover dispenser 100 includes a removable cartridge 102 and a shell 104. The removable cartridge 102 and the shell 104 can be made of a variety of materials. For example, in some embodiments, the removable cartridge 102 and the shell 104 are made of a rigid plastic, such as acrylonitrile butadiene styrene, or a metal, such as aluminum. The removable cartridge 102 and the shell 104 also can be made of different materials. For example, the removable cartridge 102 can be made of plastic and the shell 104 made of metal.

The removable cartridge 102 is configured to hold a plurality of shoe covers. Using the removable cartridge 102, it is possible to load simultaneously greater than about 10 shoe covers, such as greater than about 20 shoe covers or greater than about 30 shoe covers. The maximum number of simultaneously loadable shoe covers typically is defined by the maximum capacity of the shoe-cover dispenser 100, which depends on a variety of factors, including the height of the shoe-cover dispenser and the thickness of the shoe covers. Some embodiments of the disclosed shoe cover dispenser 100 have heights between about 10 cm and about 30 cm, such as between about 15 cm and about 25 cm. One particular example has a height of about 19.2 cm. Disclosed embodiments can have a maximum capacity, for example, less than about 1000, such as less than about 500 or less than about 300 shoe covers. Typically, the removable cartridge 102 is used to load simultaneously a quantity of shoe covers at or near the maximum capacity of the shoe-cover dispenser 100.

Figure 2A:
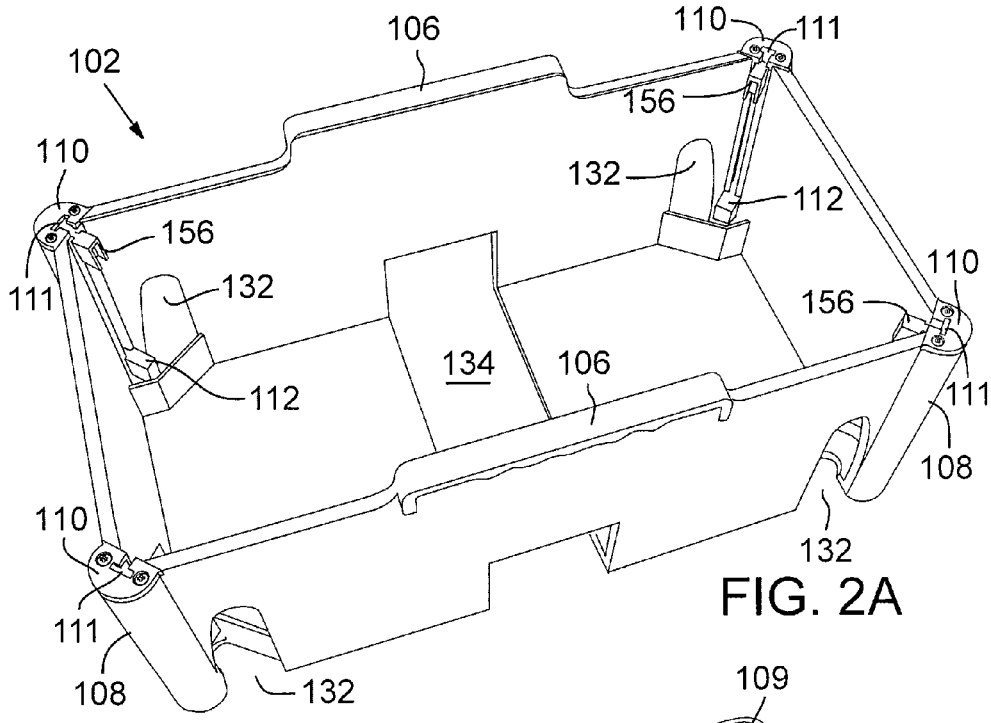
FIG. 2A is a perspective view of the removable cartridge of the shoe-cover dispenser embodiment shown in FIG. 1.
Figure 2B:
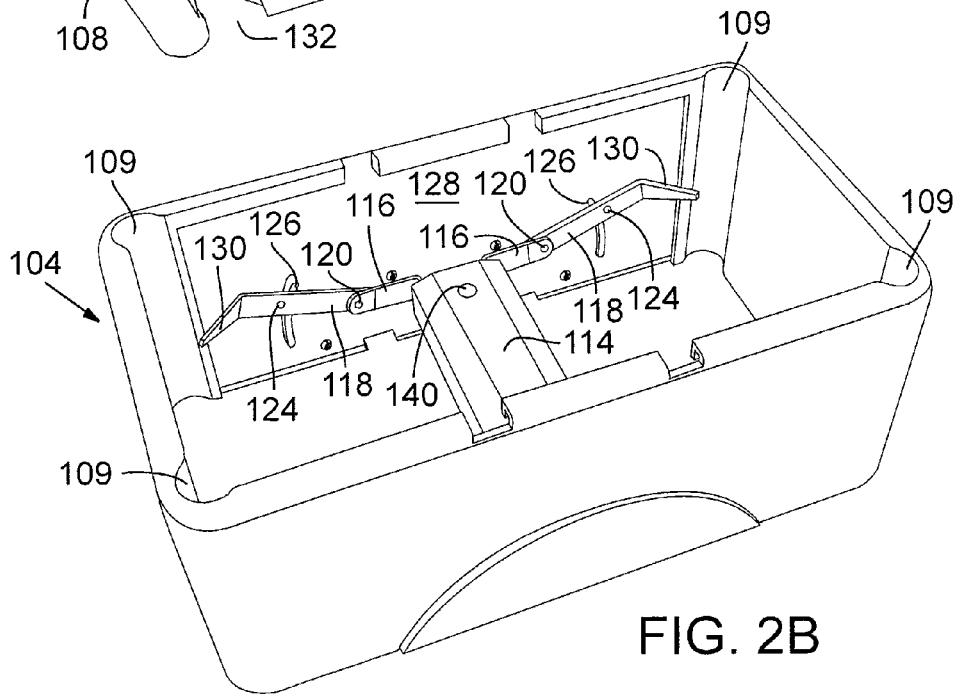
FIG. 2B is a perspective view of the shell of the shoe-cover dispenser embodiment shown in FIG. 1.

FIG. 2A shows the removable cartridge 102 separate from the shell 104. Similarly, FIG. 2B shows the shell 104 separate from the removable cartridge 102. The removable cartridge 102 includes two handles 106 to facilitate its placement into and removal from the shell 104. Some embodiments also include a locking mechanism, such as a snap-fit mechanism, to prevent movement of the removable cartridge 102 relative to the shell 104 during operation of the shoe-cover dispenser 100.

Disclosed embodiments including a removable cartridge, such as the illustrated shoe-cover dispenser 100, have several advantages over conventional shoe-cover dispensers. Conventional shoe-cover dispensers require tedious loading of individual shoe covers by the end-user. In contrast, removable cartridges can be preloaded with shoe covers, such as prior to being received by an end-user. In some disclosed embodiments, the removable cartridge is disposable. For example, an end-user can purchase preloaded cartridges and then dispose of the cartridges after they become exhausted, thus completely eliminating any need for the end-user to load or reload individual shoe covers. Alternatively, the removable cartridge can be non-disposable and configured to be reloaded. In these embodiments, the removable cartridge can be reloaded by the end-user or returned to the manufacturer for reloading.

Figure 1:
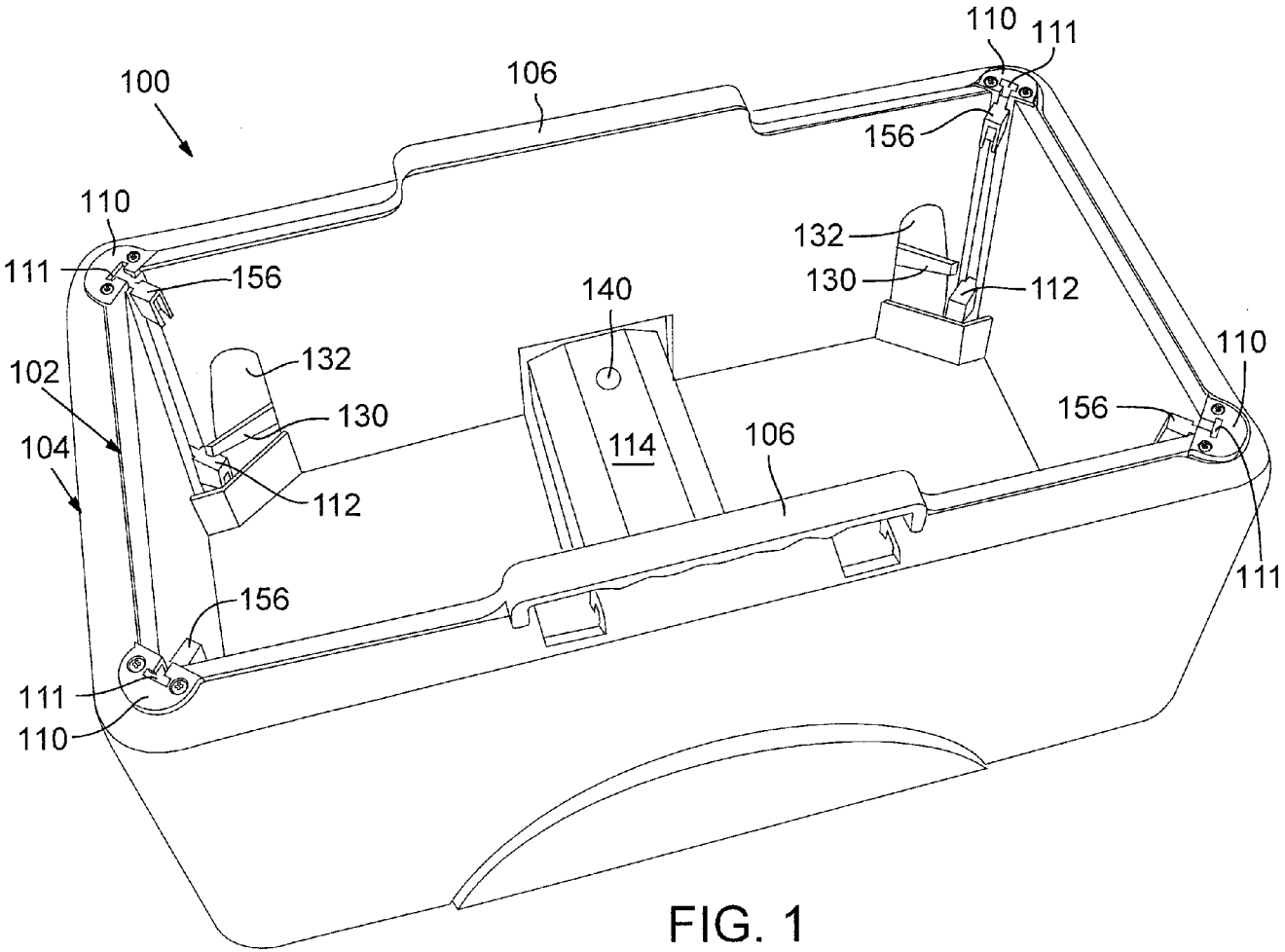
FIG. 1 is a perspective view of an embodiment of the disclosed shoe-cover dispenser including a removable cartridge and a shell.

As shown in FIGS. 1 and 2A-2B, the removable cartridge 102 and the shell 104 are shaped substantially as rectangular solids with the removable cartridge 102 fitting snug within the shell 104. In other embodiments, the removable cartridge 102 and/or the shell 104 may resemble another shape, such as a prism or an oblate spheroid. The removable cartridge 102 includes vertical columns 108 at each corner that desirably house at least a portion of the trigger mechanism for releasing the shoe covers. Each vertical column 108 slides into a respective vertical channel 109 at a respective corner of the shell 104. A cap 110 is included at the top end of each vertical column 108 to restrain components of the trigger mechanism. Each cap 110 includes a "T" shaped opening 111.

The removable cartridge 102 shown in FIGS. 1 and 2A has a rigid frame holding apart the vertical columns 108. To reduce costs, some embodiments may include a non-rigid frame or no frame between the vertical columns 108. For example, a stack of shoe covers can be sold pre-attached to four separate vertical columns 108. When an end-user receives the stack of shoe covers, he or she can place the vertical columns 108 into the respective vertical channels 109 of the shell 104 one at a time. The vertical channels 109 of the shell 104 can be configured to enclose the vertical columns 108 sufficiently to hold the vertical columns 108 in place, i.e., to prevent the vertical columns from pulling toward the center of the shoe-cover dispenser 100 in response to tension on elastic elements in the shoe covers. In these embodiments, the operation of loading each of the vertical columns 108 is still vastly more efficient than loading shoe covers individually or in small groups.

In still other embodiments, the removable cartridge 102 may include an expandable frame. For example, one or more "X" shaped expansion members can be included between the vertical columns 108 and configured to expand to a length equal to the distance between the vertical channels 109 in the shell 104. Thus, the expansion members can be expanded to hold the vertical columns 108 in place so that they can be simultaneously inserted into their respective vertical channels 109 in the shell 104. In some embodiments, the expansion members may lock in the expanded position to further facilitate simultaneous insertion of the vertical columns 108 into the vertical channels 109.

Figure 3:
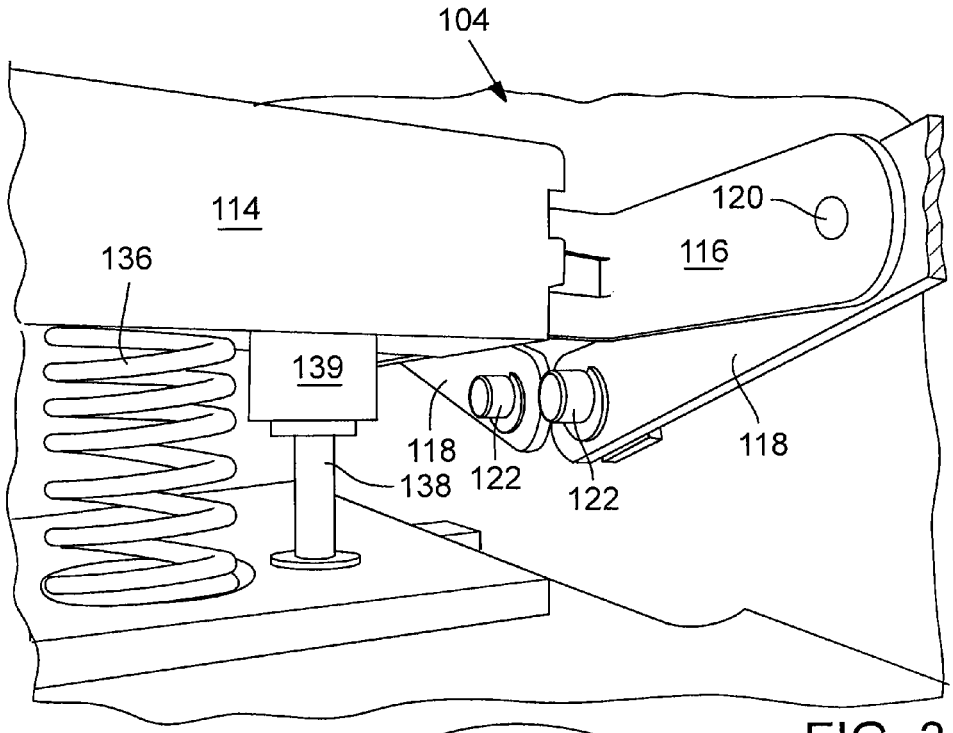
FIG. 3 is a close-up, perspective view of a portion of the shell shown in FIG. 2B below and to the side of a foot pad.

As will be described in greater detail below, activation of the trigger mechanism in the vertical columns 108 involves applying downward pressure on lower sliding members 112. This downward pressure results from downward pressure on a foot pad 114, which occurs when a user places his shoe into the shoe-cover dispenser 100. When downward pressure is applied by a user's shoe, the foot pad 114 lowers and brings with it four fixed arms 116 (two shown in FIG. 2B). Each fixed arm 116 is connected to a pivoting arm 118 with a connection pin 120. FIG. 3 provides an enlarged view of the connection between the fixed arms 116 and the pivoting arms 118. As downward pressure is transferred to the pivoting arms 118, they rotate downward about fixed pivot points 122. Movement of the pivoting arms 118 is further guided by sliding pins 124 (FIG. 2B) that project from the back of each pivoting arm and slide against radial guides 126.

Most of the length of each pivoting arm 118 is positioned near and substantially parallel to the inner surface of a side wall 128 of the shell 104. This ensures sufficient clearance for the removable cartridge 102 to slide into and out of the shell 104 without obstruction. Toward the end opposite to the end attached to the pivot point 122, each pivoting arm 118 bends away from the adjacent side wall 128. When the removable cartridge 102 slides into the shell 104, the bent portions 130 of the pivoting arms 118 project through pivoting-arm clearance-openings 132 (FIG. 2A) in the removable cartridge 102. Similarly, the foot pad 114 projects through a foot-pad clearance-opening 134 in the removable cartridge 102. When the foot pad 114 is depressed by a user's shoe, the resulting downward motion of the foot pad 114 is converted into radial downward motion of the bent portions 130. In this manner, the bent portions 130 move into vertical alignment with and then press down against the lower sliding members 112, which causes deployment of a single shoe cover by the mechanism described below. Springs 136 (one shown in FIG. 3) are positioned below the foot pad 114 to return the foot pad 114 to its original upright position after a user removes his shoe from the shoe-cover dispenser 100. As the foot pad 114 moves up, it causes the pivoting arms 118 to move radially upward. This moves the bent portions 130 out of vertical alignment with the lower sliding members 112. With the bent portions 130 retracted in this manner, the removable cartridge 102 can slide out of the shell 104 without the bent portions 130 blocking the paths of the lower sliding members 112. In some embodiments, each bent portion 130 includes an extension attached to the lower surface of its tip to facilitate contact with the corresponding lower sliding member 112. Such extensions can include gripping pads, such as rubberized pads, positioned to directly contact the lower sliding members 112.

When a user places his shoe on the foot pad 114 in the shoe-cover dispenser 100, the resulting pressure on the foot pad is not always even. To prevent tilting of the foot pad 114, and possible activation of less than all of the corner trigger mechanisms, the shoe-cover dispenser 100 includes two alignment rods 138 (one shown in FIG. 3). The alignment rods 138 are fixed to the bottom of the shell 104 and received in a slip-fit configuration within brushings 139 (one shown in FIG. 3), which are positioned within vertical holes 140 (one shown in FIG. 2B) in the foot pad 114. The alignment rods 138 and brushings 139 in the illustrated shoe-cover dispenser 100 have round cross-sections in the horizontal plane, but alignment rods 138 and brushings 139 having other horizontal cross-sectional shapes (e.g., partially rounded, triangular, rectangular, etc.) also can be used. The top of each alignment rod 138 is recessed relative to the top surface of the foot pad 114 when the foot pad 114 is in the upright position. When a user presses his shoe downward on the foot pad 114, it causes the foot pad to slide downward along the alignment rods 138 until the tops of the alignment rods are almost even with the top surface of the foot pad. Further downward movement of the foot pad 114 is prevented by the brushings 139 contacting the bottom of the shell 104.

The illustrated embodiment includes two alignment rods 138, but other embodiments can include a different number of alignment rods, such as one, three, four, five or six (multiple alignment rods are more desirable than one). Embodiments also can have other stabilizing features for the foot pad 114 instead of or in addition to alignment rods 138. For example, some embodiments include end plates abutting the foot pad 114 along its sides closest to the side walls 128 of the shell 104. From this location, the end plates can guide vertical movement of the foot pad 114 without blocking downward motion of a user's shoe. Such end plates can prevent end-to-end tilting (i.e., tilting toward each side wall 128) of the foot pad 114. To prevent front-to-back tilting of the foot pad 114, some embodiments include extensions of the end plates or separate vertical members abutting the sides of the foot pad 114 substantially perpendicular to the side walls 128. For example, the end plates can partially wrap around two or three vertical surfaces of the foot pad 114 in the area closest to each side wall 128. In these embodiments, the end plates may resemble brackets or caps.

Figure 4:
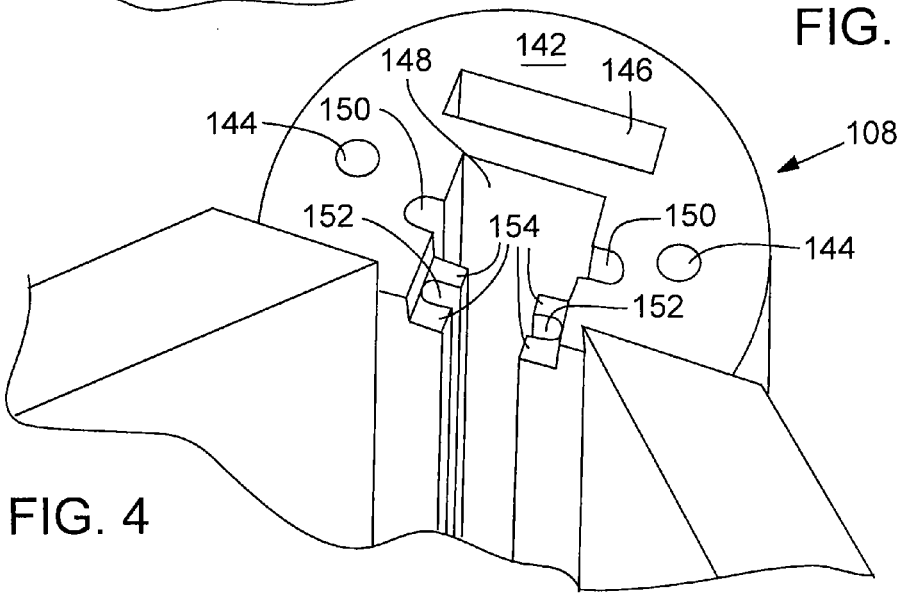
FIG. 4 is a perspective view of a top surface of a vertical column at one of the corners of the removable cartridge shown in FIG. 2A without its cap or any of its internal components.

FIGS. 4-10 illustrate the trigger mechanism in one vertical column 108 of the removable cartridge 102 shown in FIGS. 1 and 2A. FIG. 4 is a perspective view of the vertical column 108 below the cap 110 and with the internal components removed to better illustrate the internal structures. As shown in FIG. 4, the vertical column 108 includes a top surface 142 perforated by two screw holes 144, a rear channel 146 and a main channel 148. The main channel 148 includes two symmetrical first-wire channels 150 and two symmetrical second-wire channels 152. Each of the second-wire channels 152 is positioned between projections 154 having top surfaces below the top surface 142 of the overall vertical column 108. The screw holes 144 are configured to receive screws that hold the cap 110 on the vertical column 108. The function of the other internal structures is described below in relation to the components of the trigger mechanism.

Figure 5:
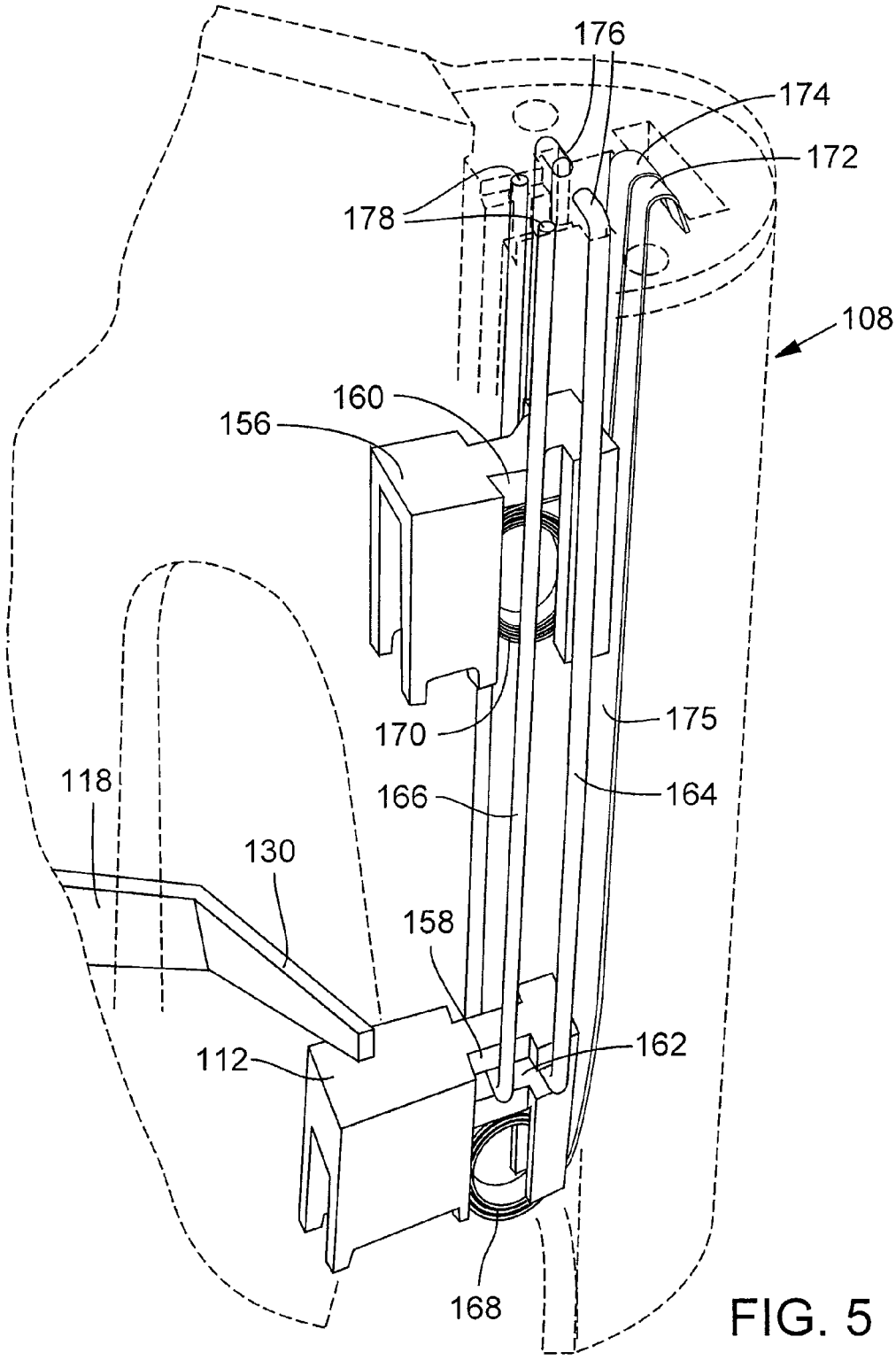
FIG. 5 is a perspective view of a vertical column at one of the corners of the removable cartridge shown in FIG. 2A with the outer surface obscured to show the internal components.

FIG. 5 is a perspective view of one of the vertical columns 108 with the internal components visible. The lower sliding member 112 described above and an upper sliding member 156 are vertically aligned and configured to slide vertically along the projections 154 (FIG. 4). The projections 154 fit snugly into notches 158, 160 on the lower and upper sliding members 112, 156, respectively. The lower sliding member 112 includes a gap 162 configured to receive bottom portions of first and second U-shaped wire assemblies 164, 166. Thus, when the lower sliding member 112 is pushed downward by the bent portion 130 of the pivoting arm 118, the entire first and second U-shaped wire assemblies 164, 166 also move downward.

Each of the lower and upper sliding members 112, 156 includes a coil spring 168, 170 causing the downward motion of the lower and upper sliding members to be resilient. Each coil spring 168, 170 is tape-like and has a hook 172, 174 at its end. The hooks 172, 174 wrap around the wall between the main channel 148 (FIG. 4) and the rear channel 146 (FIG. 4) and are held down by the cap 110. In its relaxed position, the coil spring 168 connected to the lower sliding member 112 includes a non-curled portion 175. This causes the resilient motion of the lower sliding member 112 to take place near the bottom of the vertical column 108. In contrast, the coil spring 170 connected to the upper sliding member 156 is configured to move resiliently between a point near the top of the vertical column 108 and the starting position of the lower sliding member 112. The upper sliding member 156 is smaller than the lower sliding member 112 so that the upper sliding member 156 will not interfere with motion of the bent portion 130 of the pivoting arm 118 when the upper sliding member 156 is resiliently extended to a vertical position near the starting position of the lower sliding member 112.

Depending on the number of shoe covers to be loaded, it may be useful in some embodiments to incorporate more than one upper sliding member 156. For example, embodiments designed to hold greater than about 50 shoe covers may include two or more upper sliding members 156 stacked in each vertical column 108. Alternatively, the size of the coil springs 170 can be varied. Large coil springs 170 with wide ranges of resilient motion (e.g., greater than about 10 cm) can be used in embodiments designed to hold large numbers of shoe covers (e.g., greater than about 50 shoe covers).

Figure 8:
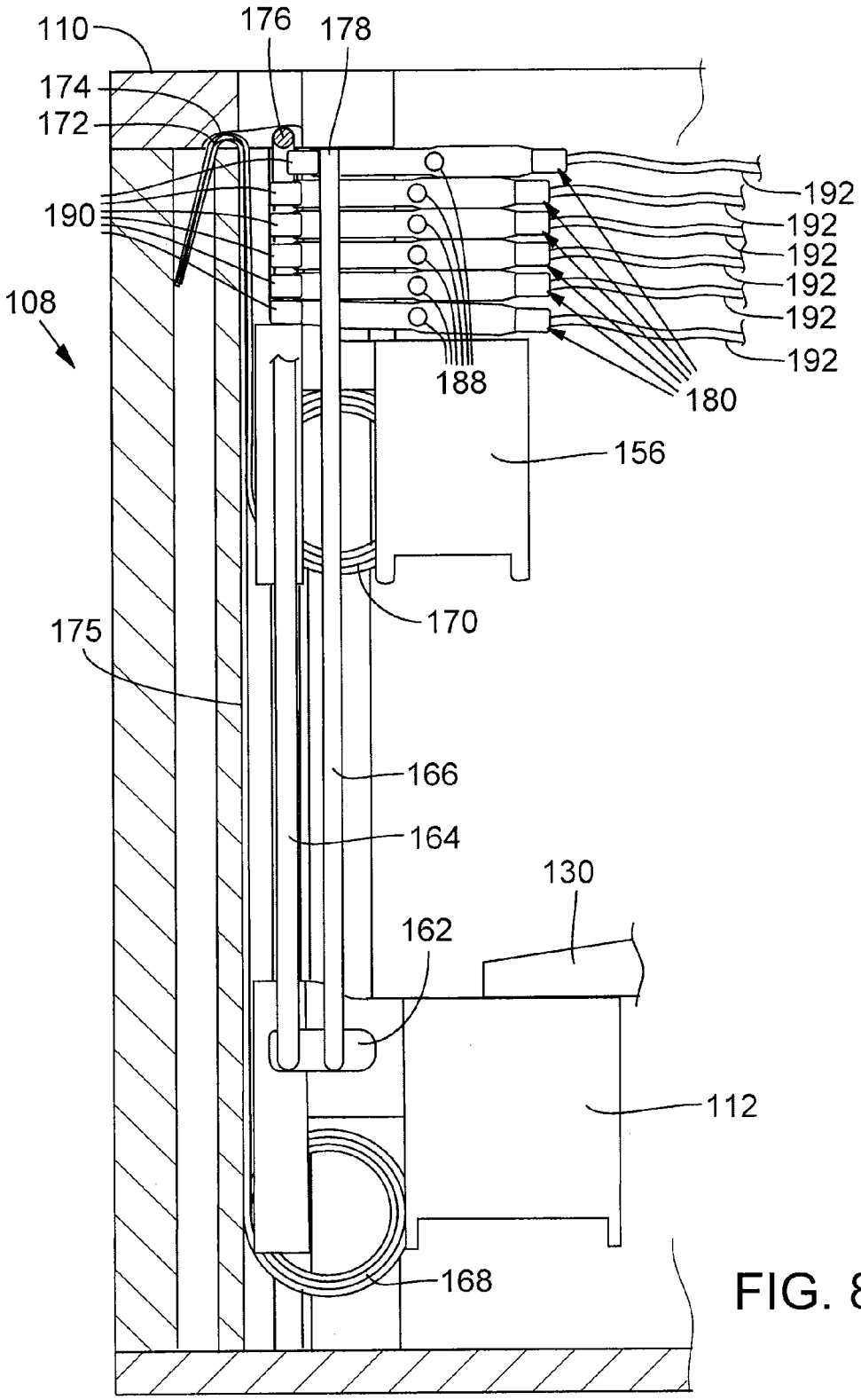
FIG. 8 is a profile view of the internal components of the vertical column shown in FIG. 5 loaded with a stack of clips staged prior to release of a shoe cover.
Figure 9:
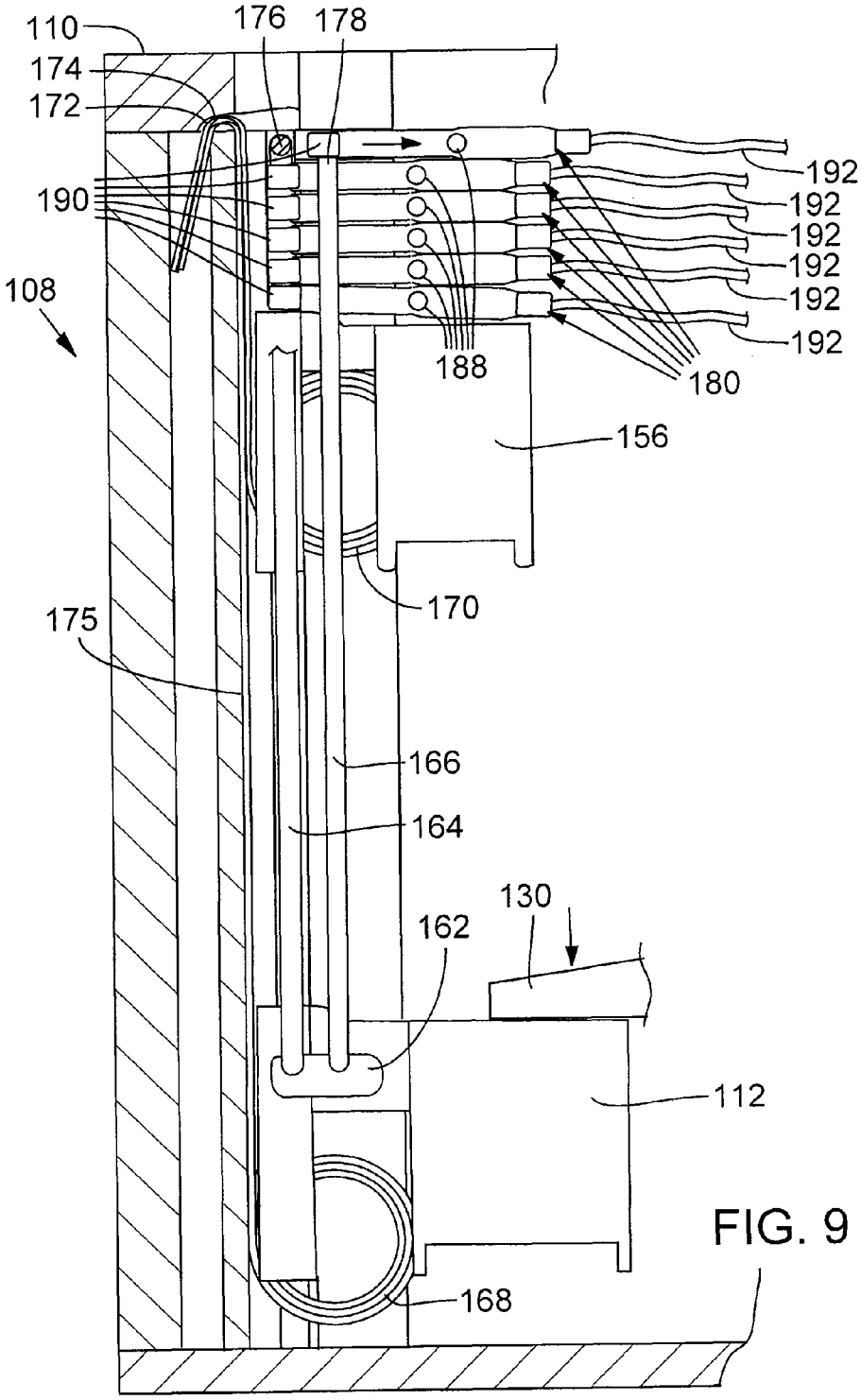
FIG. 9 is a profile view of the internal components of the vertical column shown in FIG. 8, with the uppermost clip releasing in response to downward pressure on the associated foot pad.
Figure 10:
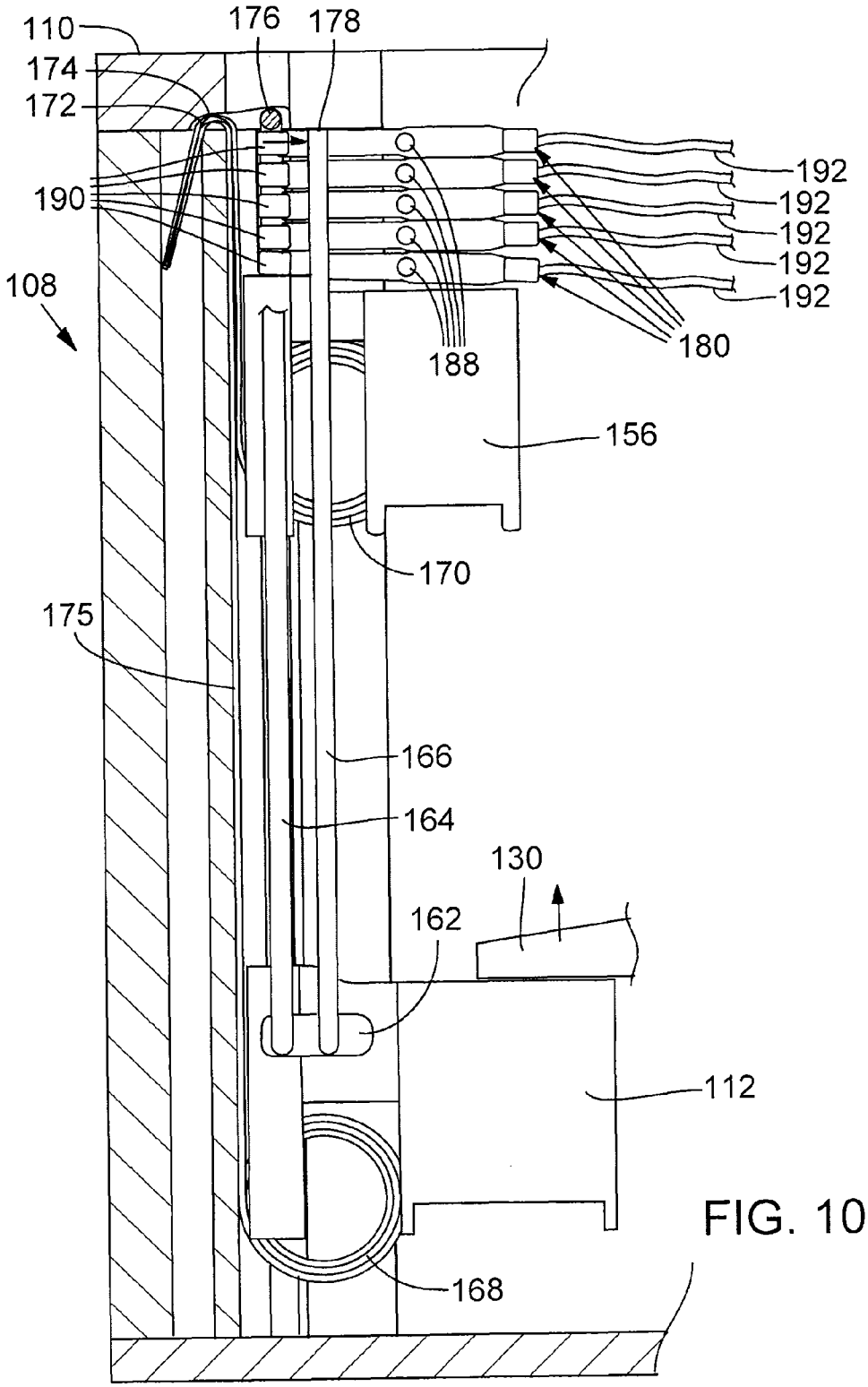
FIG. 10 is a profile view of the internal components of the vertical column shown in FIGS. 8-9 after the uppermost clip has been released and during the automatic restaging of the remaining clips.

The two vertical portions of the first U-shaped wire assembly 164 fit into the first wire channels 150 (FIG. 4) on either side of the main channel 148. Similarly, two vertical portions of the second U-shaped wire assembly 166 fit into the second wire channels 152 (FIG. 4) on either side of the main channel 148. The vertical portions of the first U-shaped wire assembly 164 terminate in bent ends 176, whereas the vertical portions of the second U-shaped wire assembly 166 terminate in straight ends 178. Both the first and second U-shaped wire assemblies 164, 166 are capable of moving vertically in response to corresponding movement of the lower sliding member 112. When the lower sliding member 112 is in its starting position, the bent ends 176 of the first U-shaped wire assembly 164 project above the top surface 142 of the vertical column 108. As shown in FIGS. 8-10, the lower surface of the cap 110 has a recess shaped to receive these bent ends 176. When the lower sliding member 112 is in its starting position, the straight ends 178 of the second U-shaped wire assembly 166 are positioned above the top surfaces of the projections 154, and slightly below or even with the top surface 142 of the vertical column 108. When the lower sliding member 112 is pressed downward by the bent portion 130 of the pivoting arm 118, the bent ends 176 of the first U-shaped wire assembly 164 and the straight ends 178 of the second U-shaped wire assembly 166 move downward simultaneously.

Figure 6:
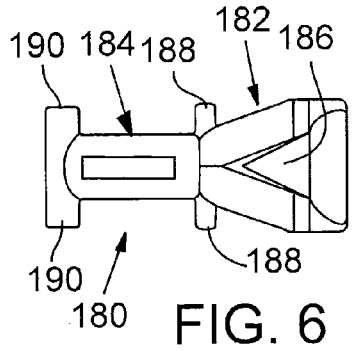
FIG. 6 is a plan view of a clip for attaching a shoe cover to a vertical column at one of the corners of the removable cartridge shown in FIG. 2A.

FIG. 6 is a plan view of an embodiment of a clip 180 for attaching a shoe cover to the vertical column 108 of the shoe-cover dispenser 100. The clip 180 includes a head 182 and a tail 184. The head 182 includes a flap 186 that projects downward relative to the plane of the page. A pair of first side pins 188 projects from the sides of the clip 180 at the junction between the head 182 and the tail 184. A pair of second side pins 190 projects from the clip 180 at the end of the tail 184 opposite to the end connected to the head 182.

Figure 7:
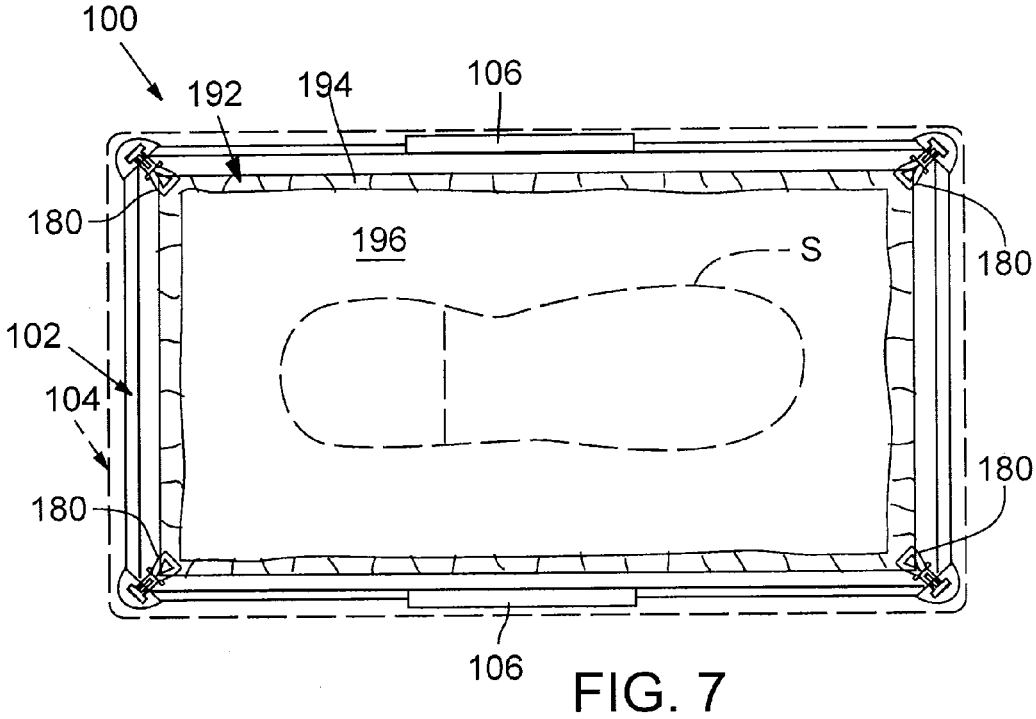
FIG. 7 is a plan view of the shoe-cover dispenser embodiment shown in FIG. 1 with a loaded shoe cover.

FIG. 7 is a plan view of the shoe-cover dispenser 100 with a loaded shoe cover 192. The shoe cover 192 includes an elastic element 194 surrounding a shoe opening 196. Four clips 180 are attached to the elastic element 194 at points distributed around the perimeter of the shoe opening 196. Each clip 180 is configured so that the elastic element 194 fits between the flap 186 and the remainder of the head 182. When the clips 180 are restrained within the vertical columns 108, the elastic element 194 is stretched and wedges into the crevice between the flap 186 and the remainder of the head 182. The shoe opening 196, therefore, is opened wide enough to receive a shoe (S). The depicted shoe-cover dispenser 100 includes four vertical columns 108, so the shoe covers 192 configured for use with the shoe-cover dispenser include four clips 180. Each clip 180 represents a respective attachment point between the shoe cover 192 and the shoe-cover dispenser 100. In other embodiments, the shoe covers 192 can be attached at a different number of attachment points, such as one, two, three, four, five or a greater number of attachment points.

The clips 180 can be loaded into the vertical columns 108 via the "T" shaped openings 111 (see FIGS. 1 and 2A) in the caps 110. For example, a clip 180 can be held substantially horizontally and the tail 184 of the clip inserted into one of the "T" shaped openings 111. After the clip 180 is pushed down below the cap 110, the force of the elastic element 194 pulls the clip toward the center of the shoe-cover dispenser 100. This causes the second side pins 190 to press against the nearest projections 154. Since the "T" shaped openings 111 are positioned further back (i.e., away from the center of the shoe-cover dispenser 100) than the position to which the second side pins 190 are pulled by the elastic element 194, the clips are prevented from exiting back out the "T" shaped openings.

FIGS. 8-10 illustrate how the shoe covers 192 are held within the shoe-cover dispenser 100 and released on demand. FIG. 8 is a profile view of the vertical column 108 in a starting position. As shown in FIG. 8, a plurality of clips 180 attached to shoe covers 192 are stacked within the vertical column 108 above the upper sliding member 156. Tension from the coil spring 170 pushes the clips 180 toward the top of the vertical column 108. At the same time, tension on the elastic element 194 of each shoe cover 192 pulls the clips 180 toward the center of the shoe-cover dispenser 100. Due to these forces, the uppermost clip 180 is pulled so that its second side pins 190 are positioned above the top surfaces of the projections 154 and restrained by the straight ends 178 of the second U-shaped wire assembly 166. The lower clips 180 are positioned further back within the vertical column 108 with their second side pins 190 within the main channel 148 and pressing against two of the projections 154. The bent ends 176 of the first U-shaped wire assembly 164 slightly overlap the second side pins 190 of the uppermost clip 180 so as to keep the uppermost clip substantially horizontal. The lower clips 180 are held substantially horizontal by the uppermost clip 180 with their second side pins 190 in direct vertical alignment with the bent ends 176 of the first U-shaped wire assembly 164.

As shown in FIG. 9, when the bent portion 130 of the pivoting arm 118 presses downward against the lower sliding member 112 (in response to downward motion of the foot pad 114), the lower sliding member 112 pulls the first and second U-shaped wire assemblies 164, 166 downward. When the straight ends 178 of the second U-shaped wire assembly 166 move down, the uppermost clip 180 is no longer restrained from moving toward the center of the shoe-cover dispenser 100 in response to tension on the elastic element 194 of the shoe cover 192. Thus, the uppermost clip 180 is released. Simultaneously, the bent ends 176 of the first U-shaped wire assembly 164 nudge downward past the second side pins 190 of the uppermost clip 180 and press firmly downward against the second side pins 190 of the lower clips. In this way, the lower clips 180 are prevented from moving upward and exiting the vertical column 108.

As shown in FIG. 10, when the bent portion 130 of the pivoting arm 118 releases the lower sliding member 112, the lower sliding member moves upward due to tension on the coil spring 168. This returns the bent ends 176 of the first U-shaped wire assembly 164 and the straight ends 178 of the second U-shaped wire assembly 166 to their original positions. The lower clips 180 move upward in response to upward motion of the bent ends 176 of the first U-shaped wire assembly 164. The uppermost clip 180 among the lower clips rises enough so that its second side pins 190 clear the top surfaces of the projections 154, allowing it to slide toward the center of the shoe-cover dispenser 100 until it is restrained by the straight ends 178 of the second U-shaped wire assembly 166. The new uppermost clip 180 is then staged for the process shown in FIGS. 8-10 to be repeated.

Figure 11:
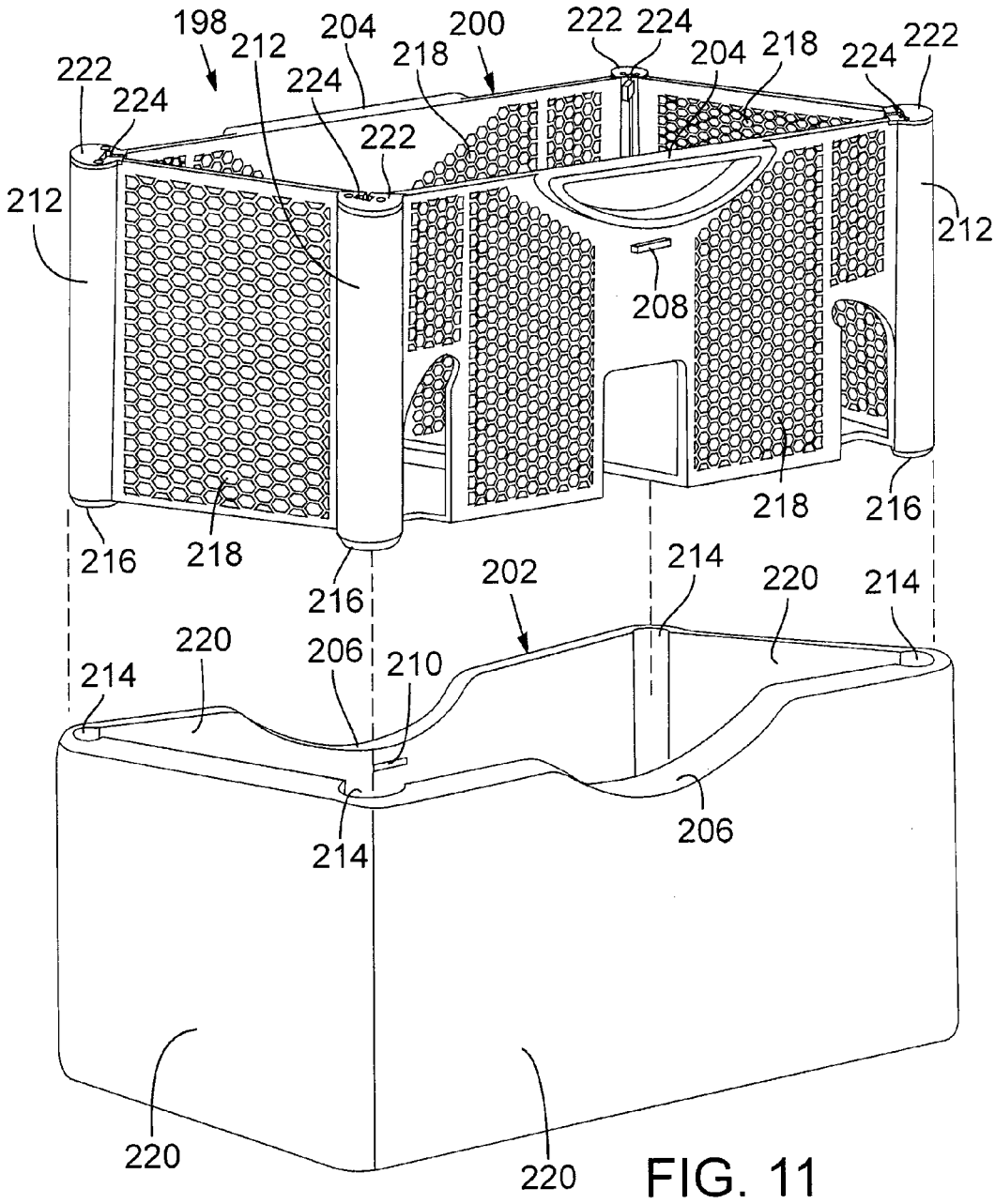
FIG. 11 is an exploded perspective view of another embodiment of the disclosed shoe-cover dispenser.
Figure 12:
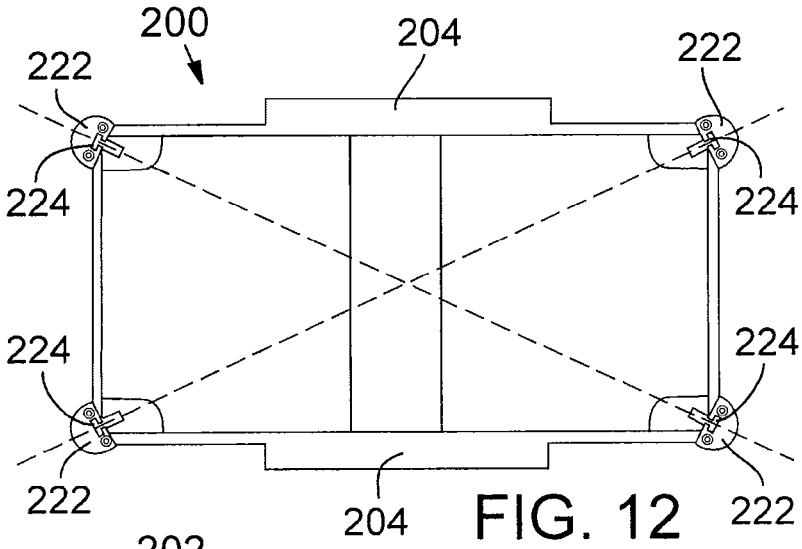
FIG. 12 is a plan view of a removable cartridge of the shoe-cover dispenser embodiment shown in FIG. 11.
Figure 13:
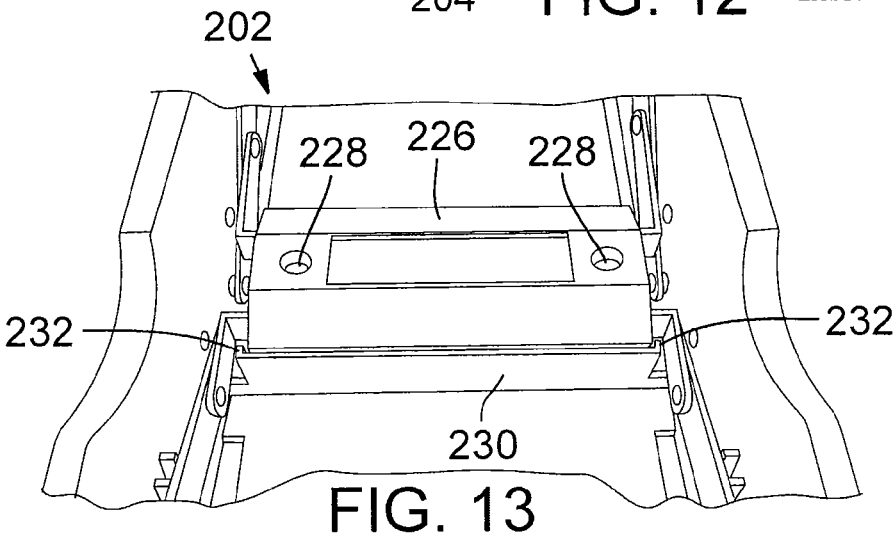
FIG. 13 is a close-up, perspective view of a portion of a shell of the shoe-cover dispenser embodiment shown in FIG. 11, including a foot pad.

FIGS. 11-13 show another embodiment of the disclosed shoe-cover dispenser. Similar to the embodiment illustrated in FIGS. 1-10, the shoe-cover dispenser 198 includes a removable cartridge 200 and a shell 202. FIG. 11 is an exploded view showing how the removable cartridge 200 and the shell 202 fit together. Handles 204 on the removable cartridge 200 fit into recesses 206 along the top edge of the shell 202. The removable cartridge 200 also includes two tongues 208 (one shown in FIG. 11) that fit into respective grooves 210 (one shown in FIG. 11) in the shell 202 when the removable cartridge is fully inserted into the shell. The fit between the tongues 208 and the grooves 210 helps to hold the removable cartridge 200 in position within the shell 202. The removable cartridge 200, however, can be removed from the shell 202 by affirmatively pulling it upward and, in some cases, flexing the handles 204 toward each other. As in the embodiment illustrated in FIGS. 1-10, the removable cartridge 200 includes four vertical columns 212 that fit into vertical channels 214 at each of the four corners of the shell 202. Each of the vertical columns 212 includes a chamfered bottom edge 216 to facilitate registration with and initial placement into the vertical channels 214.

Between the vertical columns 212, the removable cartridge 200 includes cartridge walls 218. Similarly, between the vertical channels 214, the shell 202 includes shell walls 220. The majority of each cartridge wall 218 is perforated in a mesh pattern. When the removable cartridge 200 is inserted into the shell 202, a greater amount of clearance is present between the cartridge walls 218 and the shell walls 220 than between the vertical columns 212 and the vertical channels 214. For example, the clearance between the cartridge walls 218 and the shell walls 220 can be about 0.06 inch, such as between about 0.02 inch and about 0.1 inch or between about 0.04 inch and about 0.08 inch. The clearance between the vertical columns 212 and the vertical channels 214 can be, for example, less than about 0.04 inch or less than about 0.02 inch.

FIG. 12 is a plan view of the removable cartridge 200. The removable cartridge 200 includes caps 222 on the vertical columns 212 with "T" shaped openings 224 having angles that are different than the angles of the "T" shaped openings 111 shown, for example, in FIG. 2A. Each "T" shaped opening 111 in FIG. 2A has an angle of approximately 45° relative to the adjacent guide wall 128 of the shell 104. In contrast, each "T" shaped opening 224 in FIG. 12 has an angle of approximately 27.6° relative to the longer adjacent shell wall 220 (i.e., side wall) and an angle of approximately 63.4° relative to the shorter adjacent shell wall (i.e., end wall). The angle of the "T" shaped openings 224 is such that each "T" shaped opening substantially lines up with another "T" shaped opening at the opposite corner of the removable cartridge 200. This alignment is illustrated by dashed lines in FIG. 12. Other embodiments of the removable cartridge 200 can have "T" shaped openings 224 with angles, for example, between about 10° and about 40° relative to the adjacent side walls, such as between about 15° and about 35° or between about 20° and about 30°.

FIG. 13 is a perspective view of the inside of the shell 202. The shell 202 includes a foot pad 226 and an actuating mechanism similar to the mechanism shown in FIG. 3. As with the foot pad 114 shown in FIG. 3, the foot pad 226 shown in FIG. 13 includes two alignment rods 228. The alignment rods 228, however, are larger in diameter than the alignment rods 138 shown in FIG. 3. For example, the alignment rods 228 can have diameters between about 1 cm and about 4 cm, such as between about 1.5 cm and about 4 cm. In addition, the shell 202 includes two guide plates 230 (one shown in FIG. 13). The guide plates 230 extend along the long sides (i.e., the front and the back sides in the figure) of the foot pad 226 and include tabs 232 at each end that extend across a portion of the short sides (i.e., the ends) of the foot pad 226. When the food pad 226 is pressed downward, the guide plates 230 help to prevent it from tilting. Specifically, the long portions of the guide plates 230 prevent the foot pad 226 from tilting front-to-back and the tabs 232 prevent the foot pad 226 from tilting end-to-end. The guide plates are shorter than the food pad 226, so as not to interfere with downward motion of a user's shoe.

Figure 14:
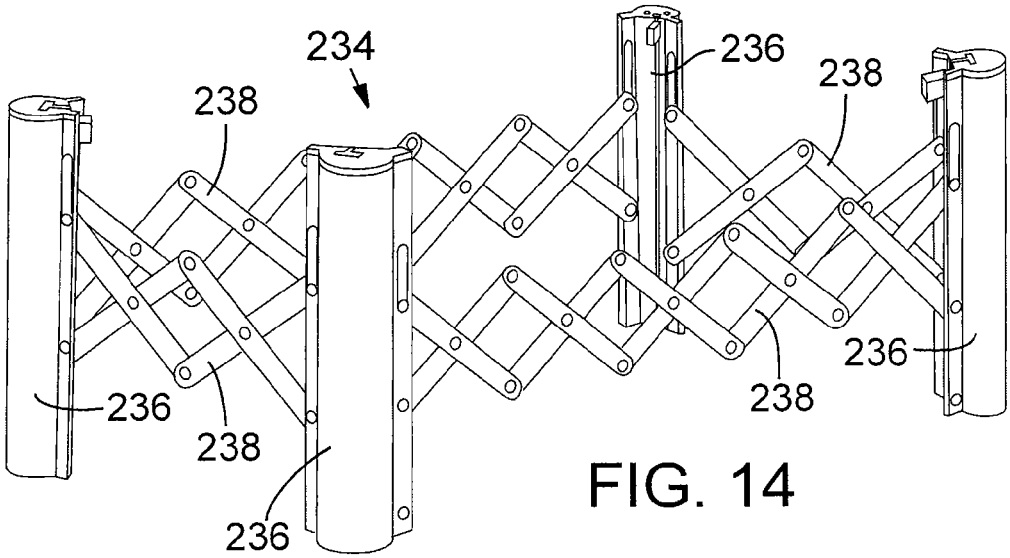
FIG. 14 is a perspective view of an embodiment of a shoe cover assembly including four vertical columns connected by expansion members.

FIG. 14 is a perspective view of another embodiment of a removable cartridge. The illustrated removable cartridge 234 includes four vertical columns 236 connected by expansion members 238. The expansion members 238 can be collapsed or extended. For example, the removable cartridge 234 can be expanded for loading at a factory, collapsed for shipping and sale and then expanded again by the end user. The removable cartridge 234 can be used with a shell having vertical channels sized to restrain horizontal movement of the vertical columns 236, such as vertical channels that surround more than 180° of the perimeter of each vertical column 236. Thus, by inserting the vertical columns 236 in the corresponding vertical channels, the expansion members 238 can be held in an expanded position. Alternatively or in addition, the expansion members 238 can include a locking mechanism (e.g., a detent mechanism, locking tabs, or an over-center mechanism) to hold them in their expanded positions. The expansion members 238 in the embodiment shown in FIG. 14 include scissoring crossbeams. In other embodiments, other types of expansion members 238 can be used, such as flexible plastic or cloth strung between the vertical columns 236.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A shoe-cover assembly, comprising:

a cartridge comprising a plurality of shoe covers each including an elastic member, the elastic member of each of the plurality of shoe covers being connected to three or more clips; and a shell for receiving the cartridge, wherein the cartridge forms three or more columns of clips, and each of the three or more clips of a respective shoe cover is positioned within a separate column of the three or more columns of clips,

2. The shoe-cover assembly according to claim 1, further comprising a plurality of vertical column members that extend into the respective cloumns of clips, the vertical cloumn members being configured to hold the columns apart such that the elastic members are stretched beyond their relaxed dimensions.

3. The shoe-cover assembly of claim 2, wherein the vertical column members are movable from a non-expanded position and an expanded position to move the elastic members from a relaxed state to a stretched state.

4. The shoe-cover assembly of claim 3, further comprising an expandable member configured to move the vertical column members from the non-expandable position to expanded position.

5. The shoe-cover assembly of claim 3, wherein the three or more columns of clips are maintained in a predefined shape prior to loading the shoe-cover assembly into the shell to facilitate alignment with the columns of clips to the vertical column members.

6. The shoe-cover assembly of claim 5, wherein the three or more columns of clips are maintained in the predefined shape by a generally rigid cartridge member.

7. The shoe-cover assembly of claim 5, wherein the three or more columns of clips are maintained in the predefined shape by a surrounding plastic member.

8. The shoe-cover assembly according to claim 1, further comprising an expandable member configured to expand to hold the clip holding columns apart such that the elastic members are stretched beyond their relaxed dimensions.

9. The shoe-cover assembly according to claim 1, wherein the shell has a vertical actuator that is configured to release one shoe cover when the vertical actuator is depressed.

10. The shoe-cover assembly of claim 1, wherein each column includes a respective clip-releasing trigger.

* * * * *

UNITED STATES PATENT AND TRADEMARK OFFICE

CERTIFICATE OF CORRECTION

PATENT NO. : 8,186,548 B2
APPLICATION NO. : 12/823048
DATED : May 29, 2012
INVENTOR(S) : Levine et al.

It is certified that error appears in the above-identified patent and that said Letters Patent is hereby corrected as shown below:

In the Claims

Column 12, line 18, claim 8, “the clip holding columns” should read -- the columns --.

Signed and Sealed this
Twenty-ninth Day of October, 2013

Teresa Stanek Rea
*Deputy Director of the United States Patent and Trademark Office*